US006105953A

United States Patent [19]

Komuro

[11] Patent Number: 6,105,953

[45] Date of Patent: Aug. 22, 2000

[54] DOCUMENT FEEDER OF PRINTER

[75] Inventor: Kiyoto Komuro, Nagano, Japan

[73] Assignee: Seiko Epson Corporation, Tokyo, Japan

[21] Appl. No.: 09/057,517

[22] Filed: Apr. 9, 1998

[30] Foreign Application Priority Data

| | | | |
|---|---|---|---|
| Apr. 9, 1997 | [JP] | Japan | 9-108142 |
| Apr. 23, 1997 | [JP] | Japan | 9-120217 |
| Oct. 31, 1997 | [JP] | Japan | 9-316512 |

[51] Int. Cl.[7] ..... B65H 3/44; B65H 5/26

[52] U.S. Cl. ..... 271/9.09; 271/273; 271/275; 271/9.13; 271/265.01; 271/186

[58] Field of Search ..... 271/9.09, 9.11, 271/9.13, 225, 273, 274, 275, 256, 258.01, 258.02, 265.01, 186

[56] References Cited

U.S. PATENT DOCUMENTS

| | | | |
|---|---|---|---|
| 4,337,935 | 7/1982 | Sawada et al. | 271/9.09 |
| 4,773,782 | 9/1988 | Hirano . | |
| 4,872,659 | 10/1989 | Kato et al. | 271/9.11 |
| 5,290,021 | 3/1994 | Murooka et al. | 271/9.09 |
| 5,651,538 | 7/1997 | Chang et al. | 271/9.09 |

FOREIGN PATENT DOCUMENTS

| | | | |
|---|---|---|---|
| 0 464 785 | 1/1992 | European Pat. Off. | B41J 13/00 |
| 0 514 155 A2 | 11/1992 | European Pat. Off. | B41J 13/10 |
| 0 574 043 A1 | 12/1993 | European Pat. Off. | G03G 15/00 |
| 355066432 | 5/1980 | Japan | 271/9.09 |
| 404246036 | 9/1992 | Japan | 271/9.09 |

OTHER PUBLICATIONS

Patent Abstracts of Japan, vol. 011, No. 316 (M–631) Oct. 15, 1987 & JP 62 100349 A (Canon Inc) May 9, 1987, *Abstract.

Patent Abstracts of Japan, vol. 096, No. 002, Feb. 29, 1996 & JP 07 266646 A (Matsushita Electric Ind. Co., Ltd.) Oct. 17, 1995 *Abstract.

Patent Abstracts of Japan, vol. 012, No. 061 (M–671), Feb. 24, 1988, & JP 62 205956 A (Tokyo Electric Co., Ltd.) Sep. 10, 1987 *Abstract.

Patent Abstracts of Japan, vol. 096, No. 002, Feb. 29, 1996. JP–07–266646 A (Matsushita Electric Ind. Co., Ltd.) Oct. 17, 1995.

Patent Abstracts of Japan, vol. 012, No. 061 (M–671), Feb. 24, 1998. JP 62–205956 A (Tokyo Electric Co., Ltd.), Sep. 10, 1987.

*Primary Examiner*—H. Grant Skaggs

*Attorney, Agent, or Firm*—Sughrue, Mion, Zinn, Macpeak & Seas, PLLC

[57] ABSTRACT

Disclosed is a printer wherein an inverted paper feeding roller (5), for inverting and feeding a recording sheet, is located under a horizontal, paper transportation path (20), along which is provided a main paper feeding roller (21) for feeding a recording sheet to a recording/writing unit; and wherein when the recording sheet reaches the main paper feeding roller (21), paper pressing rollers (8) and (16) that are in contact with the inverted paper roller (5) are separated from it to reduce the transportation resistance engendered by the recording sheet, and a movable guide member (30), which is located at the portion whereat the horizontal paper transportation path (20) and the inverted paper transportation path meet, is smoothly connected to the horizontal paper transportation path (20) to prevent the occurrence of a flipping sound at this portion.

7 Claims, 7 Drawing Sheets

DOCUMENT FEEDER OF PRINTER

BACKGROUND OF THE INVENTION

1. Field of the Invention

The present invention relates to a document feeder used for a printer.

2. Related Art

It is advantageous for a unit on which recording sheets are stacked to be provided under a recording/writing unit, and to thus reduce the installation space required for an apparatus. However, with this arrangement, a path along which recording sheets are fed must have a U shape. In addition, overlapping recording sheets, such as labels or envelopes, may be raised due to a difference in the curvatures of an interior sheet and an exterior sheet. Or, the delivery resistance engendered by strong recording sheets may increase and the accuracy in the feeding of recording sheets differ between that for those fed automatically and that for those fed manually, from outside the printer, via a horizontal paper transportation path, with different print qualities being provided.

An apparatus where a plurality of types of recording sheet stackers in different sizes are located under a recording/writing unit is also employed as means for reducing installment space. In this apparatus, however, a difference in height appears at a portion where individual U-shaped paper guides are connected or at a portion where individual paper transportation paths meet. Therefore, when a thick recording sheet passes through these portions, due to the thickness of the sheet a flipping sound is generated, or a pressing force is exerted in the feeding direction, so that the recording/writing operation is adversely affected.

SUMMARY OF THE INVENTION

To resolve the above shortcomings, it is one objective of the present invention to separate, as soon as a paper feeding roller located nearest a recording/writing unit is activated, a main paper feeding roller from a paper pressing roller that is held against it, the rollers together constituting a U-shaped paper transportation path, so that paper feeding resistance is reduced and accuracy in the feeding of recording sheets to the recording/writing unit is increased in order to eliminate a difference from the accuracy provided by manual feeding along a manually feeding path.

It is another objective of the present invention to separate, as soon as a paper feeding roller located nearest a recording/writing unit is activated, a main paper feeding roller from a paper pressing roller, which is located at a portion where a U-shaped paper transportation path and a manual transportation path meet, so that load resistance imposed on the paper feeding roller is reduced in either paper feeding mode, and clearer recording and writing is performed.

It is an additional objective of the present invention to provide a movable guide member at a portion where meeting of an inverted sheet transportation path occurs in order to smoothly connect it to a recording unit while interacting with the recording/writing operation, so that a difference in height at the boundary of the paper transportation paths is removed and the occurrence of the flipping sound and paper jams at that portion are prevented.

DETAILED DESCRIPTION OF THE PREFERRED EMBODIMENTS

Figure 1:
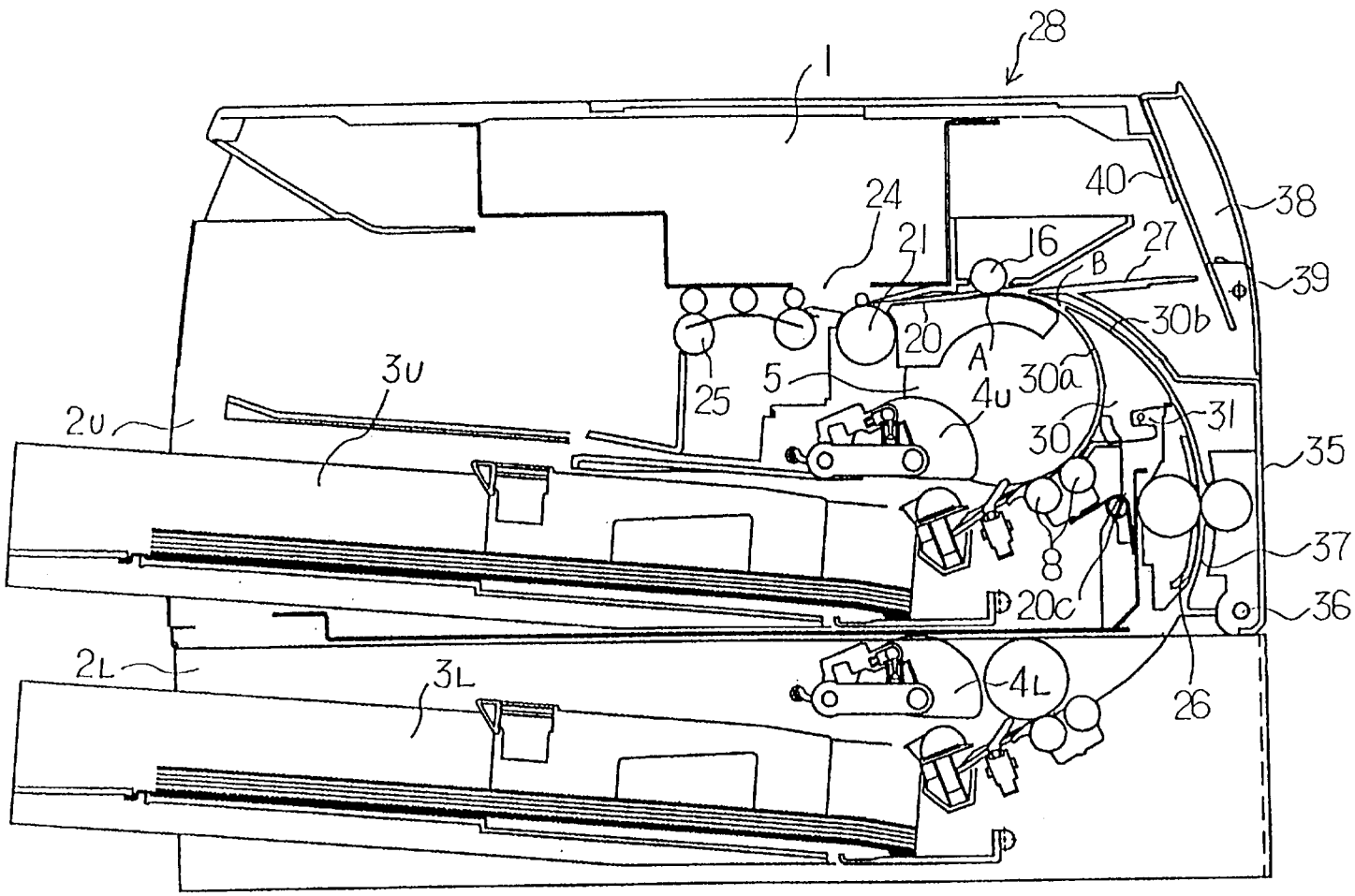
FIG. 1 is a diagram illustrating the overall structure of a printer that includes a document feeder according to the present invention.

The outline description of a printer will now be given while referring to FIG. 1 in which is depicted the overall structure of a printer.

Paper feeding units 2U and 2L, which feed different sizes or different types of recording sheets, are stacked under a recording/writing unit 1 of a printer.

Hoppers 3U and 3L in which recording sheets are stored are removably loaded into the paper feeding units 2U and 2L. A recording sheet in the upper hopper 3U is extracted by an upper pickup roller 4U and is fed by a sub-paper feeding roller 5 (inverted pager feeding roller) toward a horizontal, paper transportation path 20, which extends downstream to a main paper feeding roller 21 located in the vicinity of a recording head 24. A recording sheet in the lower hopper 3L is extracted by a lower pickup roller 4L, and is fed through a U-shaped paper guide 26 toward the flat paper transportation path 20.

A paper pressing roller 16 is located upstream in the direction in which paper is fed along the flat paper transportation path 20, and contacts and is separated from the external surface of the sub-paper feeding roller 5. The roller 16 is so attached that at a nip portion A, formed at the point the roller 16 contacts the sub-paper feeding roller 5, the end of the path leading along the U-shaped paper guide 26 meets with the horizontal, paper transportation path 20.

A movable guide member 30, having a substantially triangular shape, is rotatably attached at the portion where the sub-paper feeding roller 5 and the U-shaped paper guide 26 meet. An internal guide face 30*a* of the movable guide member 30 serves as a guide face along the sub-paper feeding roller 5, and an external guide face 30*b* constitutes one part of the U-shaped paper guide 26.

A case 28 covers the recording head 24 and the upper paper feeding unit 2U. A front door 35 for exposing the face of the U-shaped guide 26 is pivotally attached at a hinge 36, which is located at the lower end of the upper paper feeding unit 2U on the operation side.

The arc shaped internal face of the front door 35 serves as a guide 37, and constitutes a paper guide path which extends between the lower half portion of the U-shaped paper guide 26 and an external guide face 30*b* of the movable guide member 30, which will be described later, and along which a recording sheet from the lower hopper 3L is transported to the main paper feeding roller 21.

Located on the upper portion of the front door 35 are the guide face 37, which is extended along the external guide face 30*b* of the movable guide member 30, and the manual guide face 27, which is extended horizontally, by which recording sheets from the lower hopper 3L and recording sheets supplied from outside the case 28 are fed toward the nip portion A at the paper pressing roller 16.

Figure 5:
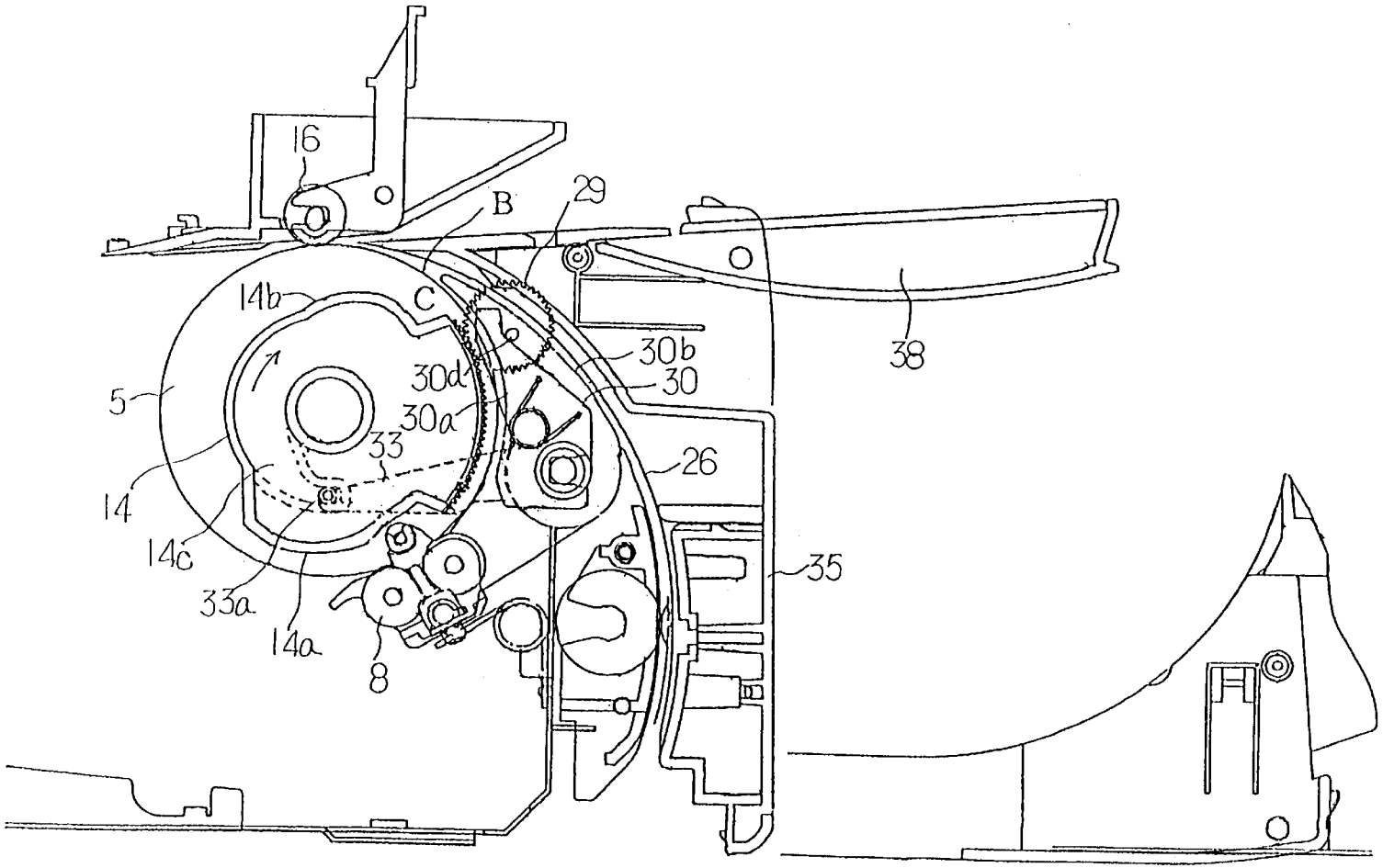
FIG. 5 is a side view of the essential portion of the document feeder in the initial state.

A hinge 39 is located at the top of the front door 35 at substantially the same position as that of the manual guide face 27, and as is shown in FIG. 5, a manual guide member 38, the internal face of which serves as a manual feeding face 40, is so attached to the hinge 39 that it can be opened to the front.

Figure 2:
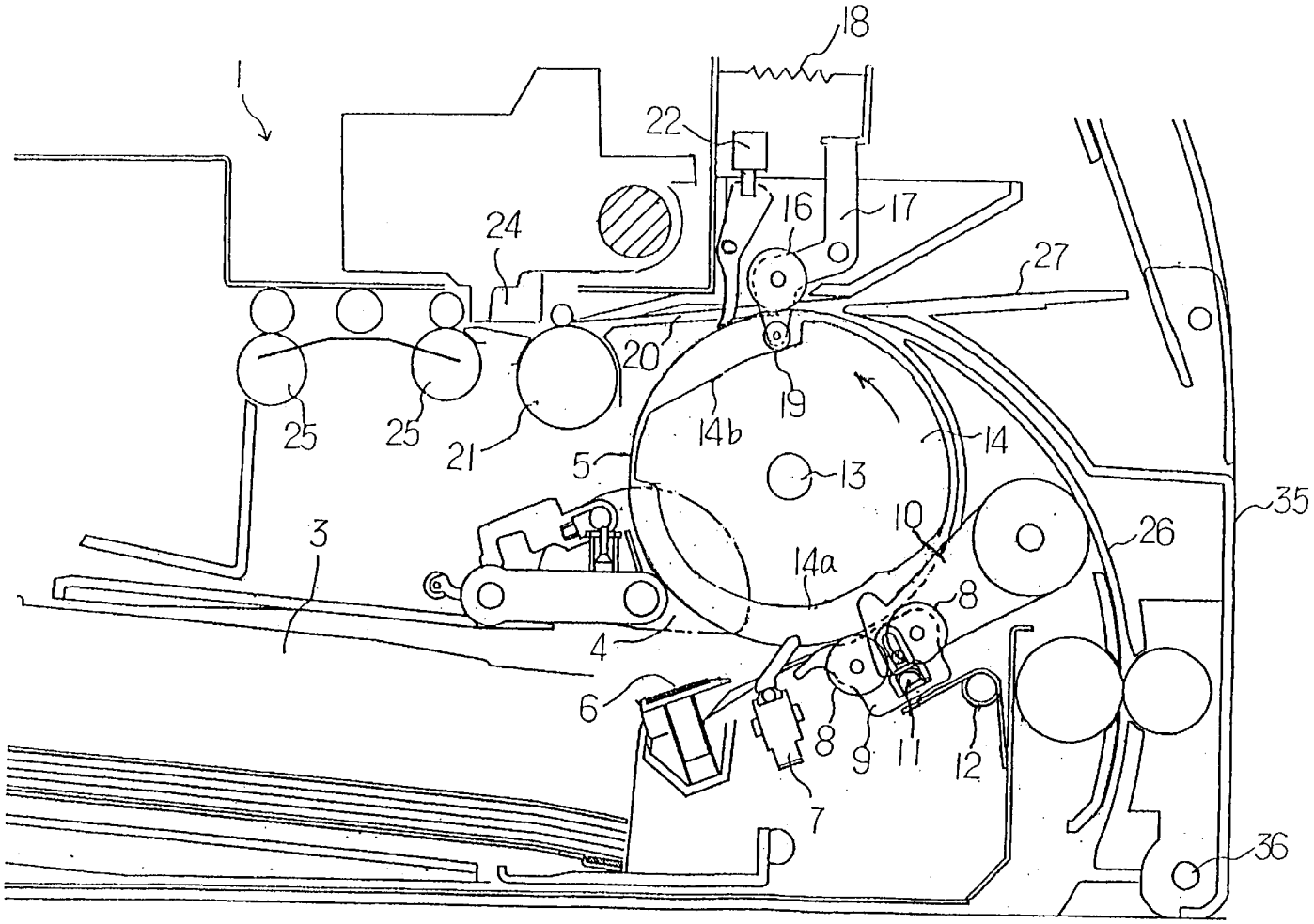
FIG. 2 is a diagram illustrating the structure of a document feeder according to one embodiment of the present invention in the paper feeding state.

FIG. 2 is a detailed diagram showing the upper paper feeding unit 2U.

A pickup roller 4 is located below the recording/writing unit of the printer 1 for extracting recording sheets from the hopper 3 and feeding them to the sub-paper feeding roller 5. Also, a horizontal paper transportation path 20, at the end of which the main paper feeding roller 21 is positioned, is provided above the sub-paper feeding roller 5, so that a recording sheet that is invertedly transported along a U-shaped route by the sub-paper feeding roller 5 is delivered to the recording head.

First and second paper pressing rollers 8 and 16 are provided at the periphery of the sub-paper feeding roller 5. When the recording sheet has reached to the main paper feeding roller 21, the paper pressing rollers 8 and 16 are separated from the external surface of the sub-paper feeding roller 5 by a roller release cam 14, which will be described later.

Of the paper pressing rollers 8 and 16, the first paper pressing rollers 8 are supported by the same support frame 9 and are attached via a pressing lever 11, having a D shape in cross section, that is located at the distal end of a first roller release lever 10, which is rotatably provided downstream of a paper edge sensor 7 in the paper feeding direction.

Pivoting of the first roller release lever 10 is included by the roller release cam 14. When the first roller release lever 10 is pivoted by a first cam face 14*a*, it separates the supported paper pressing rollers 8 from the external surface of the sub-paper feeding roller 5. However, normally, the first roller release lever 10 is driven by a spring 12 and presses the paper pressing rollers 8 against the external surface of the sub-paper feeding roller 5.

The second paper pressing roller 16 is supported by the distal end of a second roller release lever 17, which is located at a portion where the flat paper guide plate 20 and the manual guide plate 27 meet. Normally, the second paper pressing roller 16 is driven by a spring 18 that acts on the roller release lever 17, and is pressed against the external face of the sub-paper feeding roller 5. When a recording sheet or a sheet S is transported to the main paper feeding roller 21, the second paper pressing roller 16 is separated from the surface of the sub-paper feeding roller 5 by a second cam face 14*b* of the roller release cam 14, which acts on a roller 19 at the distal end of the roller release lever 17.

The roller release cam 14 is supported by a shaft 13 of the sub-paper feeding roller 5. In addition, the roller release cam 14 engages a gear 29, which is rotated by the drive motor that also drives the pickup roller 4, and rotates forward and backward as each sheet of paper is supplied, so that the paper pressing rollers 8 and 16 are brought into contact with, and are separated from the external surface of the sub-paper feeding roller 5.

Figure 4:
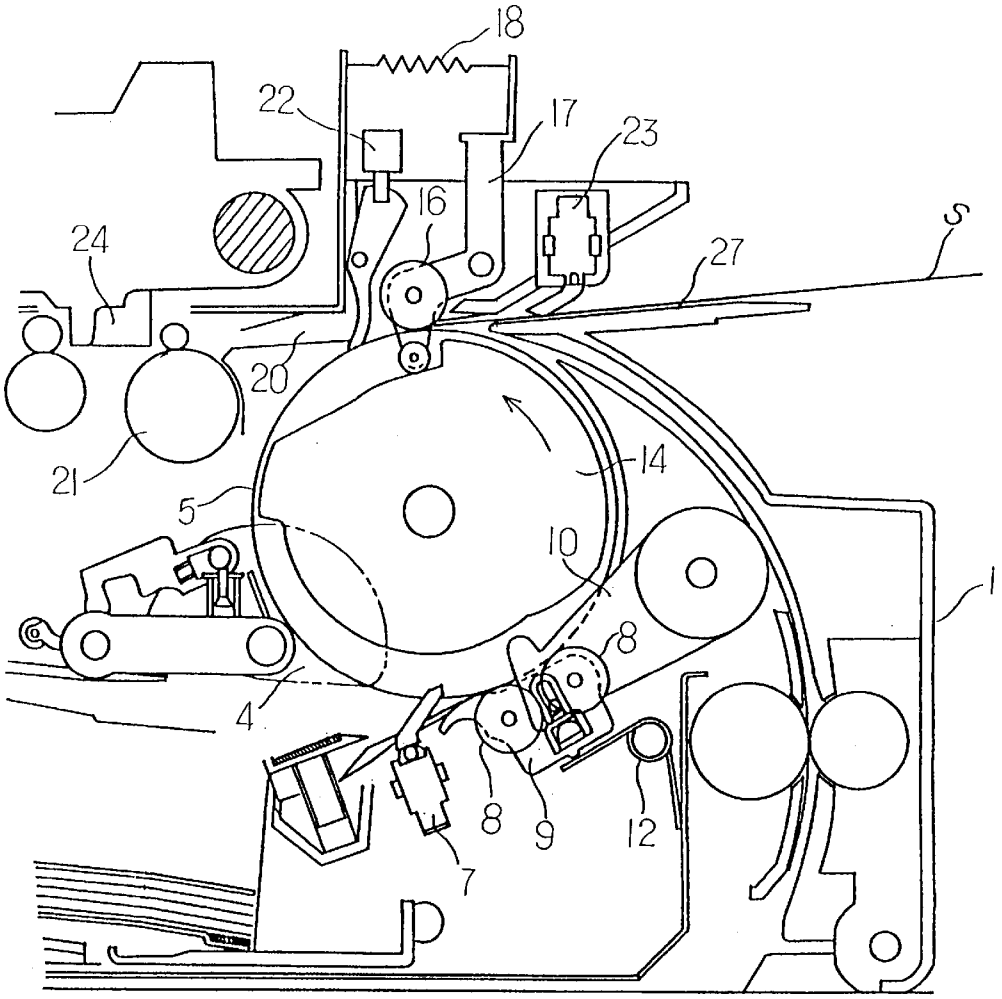
FIG. 4 is a diagram illustrating the structure of the document feeder according to the embodiment of the present invention in a manual paper feeding state.

A pad 6 for preventing multiple sheets from being fed is located at the distal end of the hopper 3; a leading edge sensor 22 is located immediately before the main paper feeding roller 21; a manual feed paper sensor 23 in FIG. 4 is located upstream of the leading edge sensor 22; and a pair of discharge rollers 25 are provided at the paper exit.

Figure 6:
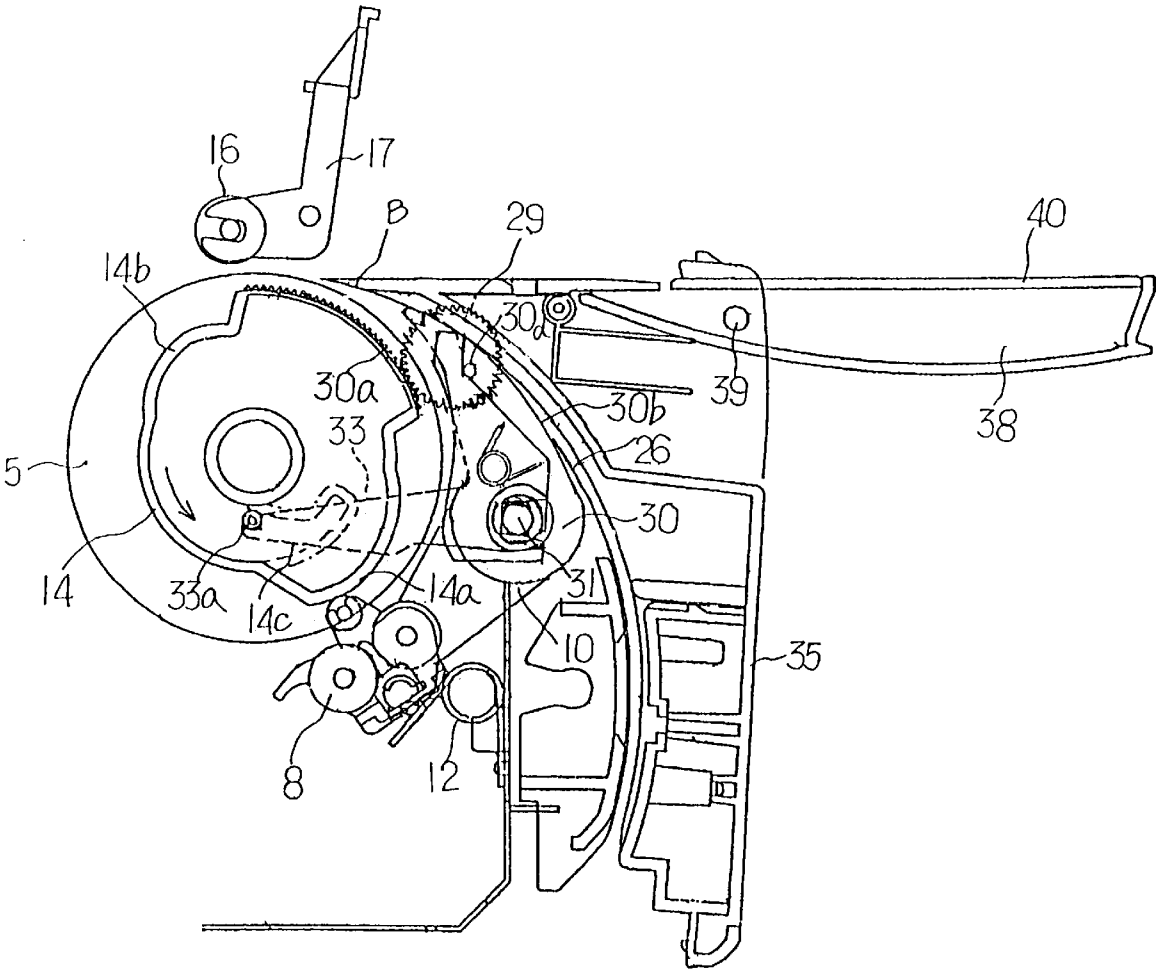
FIG. 6 is a side view of the essential portion of the document feeder in the recording/writing state.
Figure 7:
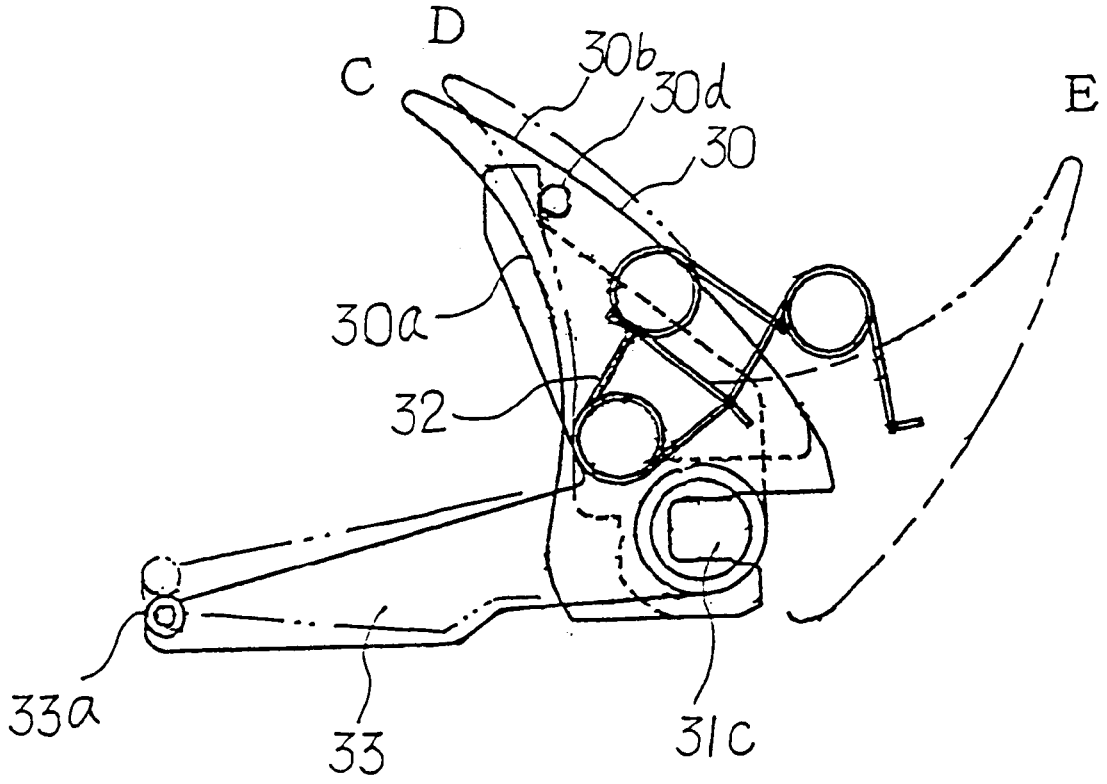
FIG. 7 is a side view of a movable guide member.

In FIGS. 5 to 7 is shown a mechanism for preventing the occurrence of a flipping sound and paper jams at the portion where paper transportation paths meet.

As is shown in FIG. 7, the movable guide member 30 is so attached that, by the force exerted by a bistable spring 32 that is fixed at one end to a frame and the other end to the movable guide member 30, it is displaced to a first position C, whereat the external guide face 30*b* is positioned along the arc-shaped guide face 26, and to a second position D, whereat the internal guide face 30*a* is smoothly brought into contact with the arc-shaped guide face 26, in order to constitute the upper paper transportation path. When a paper jam occurs, the movable guide member is displaced to an external rotation position E by the bistable spring 32 to remove the paper jam.

The roller release cam 14 has a first cam face 14*a* and a second cam face 14*b* that are so operated that, in the initial paper feeding state, the paper pressing rollers 8 and 16 are brought into contact with the external face of the sub-paper feeding roller 5, and in the printing state, they are separated from the external surface of the sub-paper feeding roller 5. Also, a cam groove 14*c*, shaped like a horn, is formed in the roller release cam 14 to displace the movable guide member 30 to the first position C and to the second position D.

A cam follower 33, which operates the movable guide member 30, is pivoted at a support shaft 31*c*, while a roller 33*a* at its distal end engages the cam groove 14*a* of the roller release cam 14. This rotational movement is transmitted to the movable guide member 30 via a pin 30*d*, so that the movable guide member 30 is displaced to the first position C and to the second position D.

An explanation will now be given for the document feeding operation, from the upper paper feed unit that has a large curvature, that is performed by the thus structured document paper feeder.

In the normal paper feeding process, when a paper feed signal is received, the roller release cam 14 is rotated in the direction indicated by an arrow, and the first cam face 14*a* releases the depression force exerted on the first roller release lever 10. The two paper pressing rollers 8 are brought into equal contact with the external surface of the sub-paper feeding roller 5 by the force of the spring 12 that acts on the support frame 9. At the same time, the cam face 14*b* releases the depression force of the second roller release lever 17, and the second pressing roller 16 on the lever 14 is brought into contact with the sub-paper feeding roller 5 by the force exerted by the spring 18.

In this condition, as is shown in FIG. 5, the cam follower 33 that engages the cam groove 14*c* of the roller release cam 14 is rotated counterclockwise, and the movable guide member 30 is displaced via the pin 30*d* to the paper feed position C, i.e., the internal guide face 20*a* contacts the external surface of the sub-paper feeding roller 5 and the external guide face 20*b* contacts the arc-shaped guide face 26. As a result, the upper and lower paper transportation paths are formed.

At this time, the pickup roller 4 is rotated counterclockwise and a recording sheet is extracted from the hopper 3. Then, the recording sheet is passed across the pad 6, for the prevention of multiple sheet feeding, and the paper edge sensor 7 to the sub-paper feeding roller 5, and while pressure is applied to it by the paper pressing rollers 8, it is invertedly transported and is passed through the second paper pressing rollers 16 to the flat paper guide plate 20.

Figure 3:
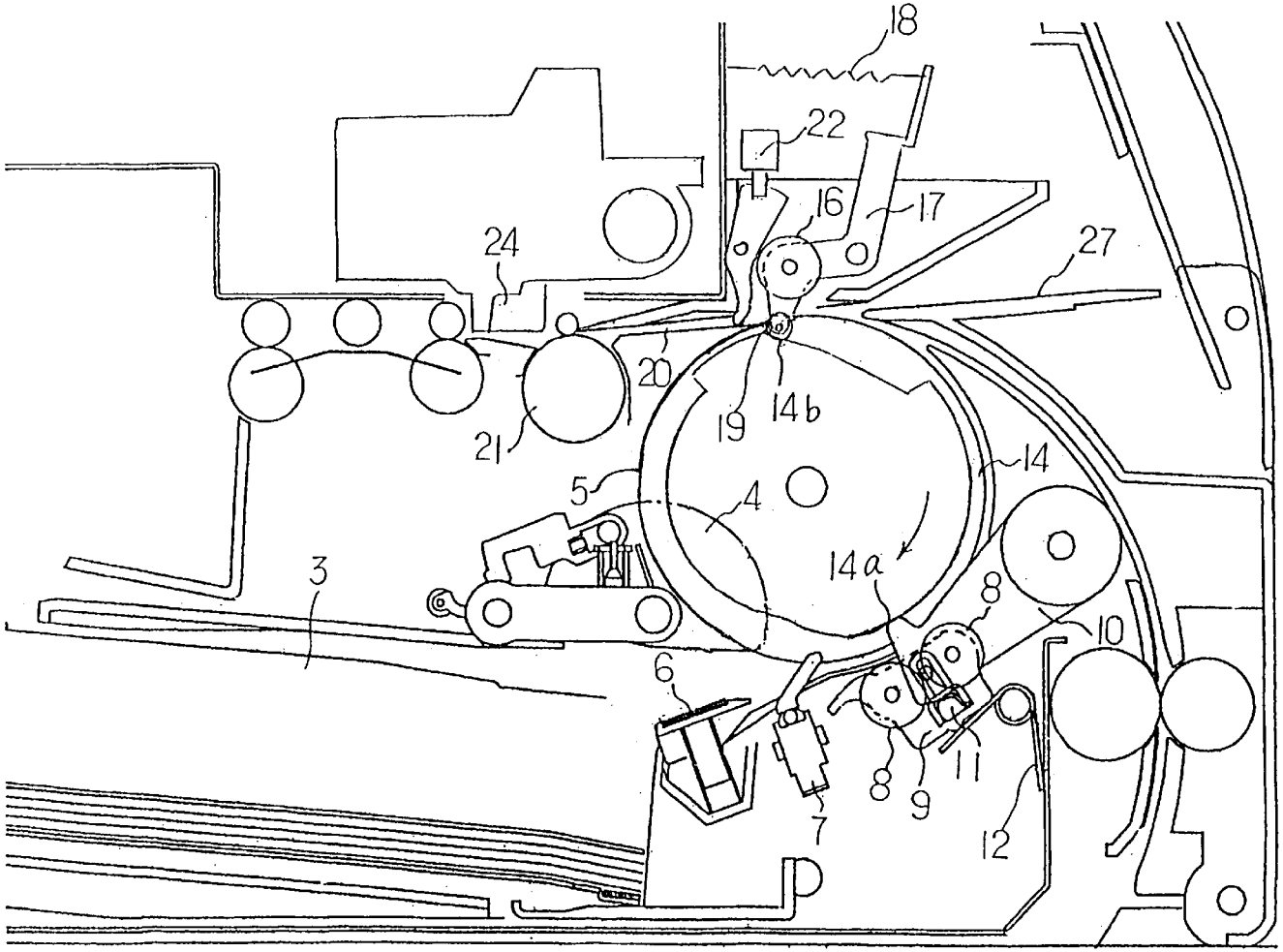
FIG. 3 is a diagram illustrating the structure of the document feeder according to the embodiment of the present invention in the recording/writing state.

When the recording sheet is delivered to the main paper feeding roller 21, the leading edge sensor 22, which is located at a position immediately after the second paper pressing rollers 16, detects the leading edge of the recording sheet and transmits a detection signal to halt the driving force transmitted to the sub-paper feeding roller 5. At the same time, as is shown in FIG. 3, the roller release cam 14 is rotated in reverse, and with the cam face 14a, the first roller release lever is rotated counterclockwise to separate the two paper pressing rollers 8, which pivot at the support frame 9, from the external surface of the sub-paper feeding roller 5. At the same time, with the cam face 14*b*, the second roller release lever 17 is rotated clockwise to separate the paper pressing rollers 16 on the lever 17 from the external surface of the sub-paper feeding roller 5.

As the roller release cam 14 is rotated in reverse, the cam follower 33 is rotated clockwise toward the wide opening of the cam groove 14*c* by the force of the bistable spring 32, which acts on the movable guide member 30. Thereafter, the movable guide member 30 is rotated clockwise via the pin 30*d* and is displaced to position D. Then, the external guide face 30*b* abuts upon the arc-shaped guide face 26, while the internal guide face 30*a* is smoothly brought into contact with the arch-shaped guide face 26. As a result, a difference in height that tends to occur at the meet portion B is eliminated.

Therefore, the recording sheet avoids the resistance encountered when paper is fed, i.e., the feeding performed by the pinch roller 4 and the pressing applied by the paper pressing roller 8 and 16. Further, in consonance with the free rotation of the sub-paper feeding roller 5, the distance the recording sheet is fed is accurately controlled by the main paper feeding roller 21 on the flat paper transportation path 20, and the recording sheet is delivered to the recording head 24.

When the tailing edge of the recording sheet reaches the meet portion B where the curved paper transportation path changes to the flat paper transportation path, the recording sheet is smoothly moved along the internal guide face 30*a* of the movable guide member 30 to the arc-shaped guide face 26. A flipping sound does not occur at this time, and the impelling of paper forward in the paper feeding direction, which occurs at this portion B due to the strength of the paper, is reduced. In addition, the occurrence of paper jams at the portion B is also reduced, so that a more precise and clearer recording image can be obtained.

When a paper jam occurs at the meet portion B, as is shown in FIG. 5, the front door 35 is opened and the movable guide member 30 is rotated clockwise. Then, the movable guide member 30 is held at a release position E by the bistable spring 32, and a required jam process can be performed.

For the printing of a manually fed sheet S, such as a post card, as is shown in FIGS. 5 and 6, a manual guide member 38 is rotated externally until it is positioned horizontally, and a sheet S is inserted from the outside of the printer 1 toward the nip portion A formed by the sub-paper feeding roller 5 and the second paper pressing roller 16.

A manually loaded sheet sensor 23, which is located along a manual feeding path, detects the leading edge of the sheet, and in consonance with the detection signal, the sub-paper feeding roller 5 is rotated to feed the sheet S to the main paper feeding roller 21.

The leading edge sensor 22, which is located immediately before the main paper feeding roller 21, detects the sheet S. In response to the detection signal, the driving force supplied to the sub-paper feeding roller 5 is halted, and the rotation of the main paper feeding roller 21 begins. With only the rotational force supplied by the main paper feeding roller 21, the speed at which the manually loaded sheet S is transported is precisely controlled, while the sheet S is delivered to the recording head 24 and a clear image is formed on the face of the sheet S.

In the above embodiment, the paper pressing rollers 8 and 16 are provided at two locations, downstream of the paper stacker and at the portion where the manually feeding path meets. In order to maintain constant accuracy for both automatic document feeding and manual feeding, paper pressing rollers that are separable must at least be located at the meet portion.

What is claimed is:

1. A document feeder for a printer having an inverted paper transportation path formed below a paper transportation path extending to a recording unit, for inverting a recording sheet and delivering the recording sheet to said paper transportation path, said document feeder comprising:

an inverted paper feeding roller for inverting and feeding a recording sheet;

paper pressing rollers operative to press against said inverted paper feeding roller and located in such a manner that said pressing rollers are separable from said inverted paper feeding roller;

a main paper feeding roller, located downstream of said inverted paper transportation path, for feeding a recording sheet to said recording unit; and a cam mechanism for providing synchronization with a paper feeding operation of said main paper feeding roller for separation of said paper pressing rollers from said inverted paper feeding roller.

2. A document feeder according to claim 1, wherein a transmission of a driving force to said inverted paper feeding roller is stopped by synchronizing with said paper feeding operation of said main paper feeding roller.

3. A document feeder according to claim 1, wherein one of said paper pressing rollers presses on said inverted paper feeding roller at a location defined by the meeting of said paper transportation path along which a recording sheet is fed to said recording unit, and a a manual loaded paper transportation path, and pressingly moves with respect to said inverted paper feeding roller.

4. A document feeder for a printer, disposed below a paper transportation path extending to a recording unit, comprising:

an inverted paper transportation path along which a recording sheet is inverted and delivered to said paper transportation path;

an inverted paper feeding roller, for inverting and feeding a recording sheet, located upstream of said paper transportation path;

a manually fed paper transportation path, along which a manually fed paper sensor is located, located upstream of said paper transportation path; and a main paper feeding roller for feeding a recording sheet to said recording unit, said main paper feeding roller disposed downstream from a portion at which said inverted paper transportation path and said manually fed paper transportation path meet, wherein paper pressing rollers that are brought into contact with, and separated from, said inverted paper feeding roller are provided at the meeting portion, said inverted paper feeding roller driven in response to one of an automatic document feed signal and a detection signal from said manually fed paper sensor and, when said recording sheet reaches to said main paper feeding roller, said main paper feeding roller is driven and said paper pressing rollers are separated from said inverted paper feeding roller.

5. A document feeder for a printer, having at least a first and second inverted paper transportation paths provided below a horizontal paper transportation path, each of said first and second inverted paper transportation paths operative to invert a respective recording sheet and feed the respective recording sheet to said horizontal paper transportation path extending to a recording unit, comprising:

a guide member having an internal face serving as a guide surface along an inverted paper feeding roller, at least a portion of said internal face of said guide member being located at a first position where said horizontal paper transportation path and said first inverted paper transportation path meet, wherein at least said portion of said internal face of said guide member is displaceable to a second position located on said first inverted paper transportation path so that said guide member is smoothly brought into contact with said horizontal paper transportation path, wherein said first inverted paper transportation path is defined by a space between said inverted paper feeding roller and said internal face of said guide member; and a cam mechanism interacting with a recording operation to displace at least said portion of said internal face of said guide member from said first position to said second position.

6. A document feeder according to claim 5, wherein said cam mechanism includes a portion for separating paper pressing rollers and is rotated by contacting said inverted paper feeding roller.

7. A document feeder according to claim 5, further comprising:

a bistable spring for acting on said guide member so that said internal face of said guide member is stably displaced to at least one of said first position and a position at which a paper jam can be removed.

* * * * *